US007669273B2

(12) United States Patent
Douglas

(10) Patent No.: US 7,669,273 B2
(45) Date of Patent: Mar. 2, 2010

(54) CORNER PAINTING ROLLER SYSTEM

(76) Inventor: Russell Douglas, 518 Porter St., North Versailles, PA (US) 15137

( * ) Notice: Subject to any disclaimer, the term of this patent is extended or adjusted under 35 U.S.C. 154(b) by 283 days.

(21) Appl. No.: 11/440,017

(22) Filed: May 25, 2006

(65) Prior Publication Data

US 2007/0271721 A1 Nov. 29, 2007

(51) Int. Cl.
*B05C 17/02* (2006.01)

(52) U.S. Cl. ..... 15/230.11; 15/257.06; 15/230.18; 492/19

(58) Field of Classification Search ..... 15/230.11, 15/230.18, 257.05, 257.06; 492/19
See application file for complete search history.

(56) References Cited

U.S. PATENT DOCUMENTS

| | | | | |
|---|---|---|---|---|
| 2,779,960 | A | 2/1957 | Ogren | |
| 2,929,089 | A | 3/1960 | Nall | |
| 2,994,899 | A | 8/1961 | Moilanen | |
| 3,058,145 | A | 10/1962 | Hegedus | |
| 3,702,739 | A | 11/1972 | Rentfrow | |
| 3,822,846 | A * | 7/1974 | Jesionowski | 248/210 |
| 4,257,140 | A * | 3/1981 | Downing | 15/230.11 |
| 5,511,279 | A * | 4/1996 | Ippolito | 15/257.06 |
| 2003/0217427 | A1 * | 11/2003 | Martin | 15/230.11 |
| 2004/0111818 | A1 | 6/2004 | Ma | |

* cited by examiner

*Primary Examiner*—Laura C Guidotti
(74) *Attorney, Agent, or Firm*—Browdy and Neimark, PLLC

(57) ABSTRACT

A system for applying liquid coating such as paint to a surface including a spindle-shaped roller cover having painting fabric permanently attached to the roller cover body and that can match the nap of the paint fabric used in a conventional roller used to paint flat surfaces; and a paint pan adapter which enables the user to use the corner-painting roller cover in a conventional paint pan as a reservoir for holding the coating material. The adapter is provided with a V-shaped grille which has a plurality of holes. The grille is elongated like a trough. Part of the length of the grille is submerged in the coating material and part is not. The trough along which the roller cover roles makes it possible for the roller cover to pick up paint from the reservoir of the paint pan and to remove excess coating material from the roller cover and return it top the reservoir.

4 Claims, 10 Drawing Sheets

CORNER PAINTING ROLLER SYSTEM

FIELD OF THE INVENTION

The present invention relates to a system for applying surface coatings to areas where two or more surfaces join each other, such as corners.

BACKGROUND OF THE INVENTION

Conventional paint rollers are composed of two parts: a wire roller that freely spins on an axle as the roller move across a surface, and a roller cover, a fabric-covered cylinder which slips onto the wire roller. The wire roller has a handle for the user to grasp. When attached to the wire roller, the roller cover is made to absorb paint from a reservoir, such as a paint pan. This absorbed paint is then applied to a surface by a rolling action. Currently, applicators of liquid surface coating materials such as paints use a fabric covered roller to rapidly apply these coatings to surfaces. While these rollers work well on flat surfaces, they cannot be used to apply surface coatings into deep corners where two or more surfaces meet. These deep corners occur, for example, in a room where two walls meet, or where a ceiling and one or more walls come together. To overcome this limitation of conventional rollers or covers, corners had been coated using a brush or paint pad, which is a slow and tedious process. In painting a room with conventional rollers, painting of corners with a brush or painting pad is the limiting factor in the expeditious completion of the job.

As painting technology advanced, a number of corner-painting devices have been patented. These corner-painting rollers are of two basic types:

1. rollers which have the paint fabric solidly attached to the roller; and
2. rollers wherein the paint fabric is not solidly attached to the roller.

For corner-painting rollers which have the fabric solidly attached to the roller body, the roller is assembled with nuts and bolts. This assembly requires the use of wrenches, which are not always readily available during a coating operation, and which occasionally fail to work properly. The nuts and bolts of these rollers protrude from the device and will be covered with coating material during use of the roller. This results in a difficult and messy disassembly of these rollers, with fouling of hands and wrenches with the coating material. The protruding nuts and bolts of some of these corner-painting rollers can dig into the surface being coated, gouging the surface and marring the finish.

In the case of corner-painting rollers where the fabric is not firmly or permanently attached to the roller cover, the fabric fits over the body of the roller cover like a stocking, with no nuts and bolts required for assembly. The roller-cover fabric is slipped over the roller cover body which is attached to the axle of a roller. This assembly is a two-step process. Since the fabric of this roller cover is not permanently attached to the roller cover body mechanically or with adhesive, it is not anchored in place. When this roller is in use, the fabric may be warped, with a possible complete detachment of the fabric from the cover body. This inevitably leads to marring of the wall finish, messy cleanups, and optionally messy and time consuming reattachments of the paint fabric to the roller cover body. These problems are exacerbated when the roller is used quickly.

Accessories for loading rollers with paint or other coating materials must be efficient in filling rollers with coating materials. For adequately loading a roller with paint or other coating material, the device must provide the painter adequate space in the reservoir for manipulating the roller. This space requirement is, of course, somewhat dependent on the size of the roller, and is used to coat the roller evenly and to drop off excess paint into the paint reservoir.

Adequately sized painting accessories cannot fit into a paint can unless the roller is too small to be useful, because there would not be sufficient room to properly load the roller with paint.

SUMMARY OF THE INVENTION

It is an object of the present invention to overcome the aforementioned deficiencies in the prior art.

It is another object of the present invention to provide a system for applying coatings to corners.

It is a further object of the present invention to provide a system for applying coatings to corners where two or more surfaces come together.

The system includes a corner-roller cover and an adapter. The corner-roller cover is designed to rapidly deliver coatings to corners where two or more surfaces come together, resulting in the complete covering of the space with an even-coating. The adapter works in conjunction with a conventional paint pan, and aids in loading the corner-roller cover with the surface coating (paint, etc.). Once the corner-roller cover is loaded with the surface coating material, the coating can be applied to the corner with great ease and speed.

For purposes of the present invention, the terms "paint" and "coating material" can be used interchangeably, without limiting the invention to either term.

DETAILED DESCRIPTION OF THE INVENTION

Figure 1A:
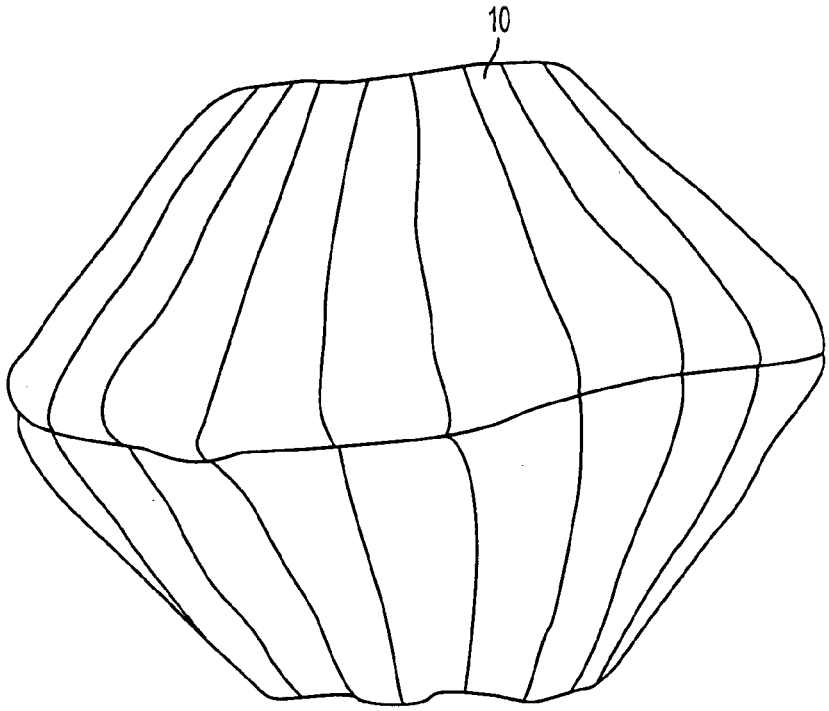
FIG. 1A shows a top view of a corner-roller cover.
Figure 1B:
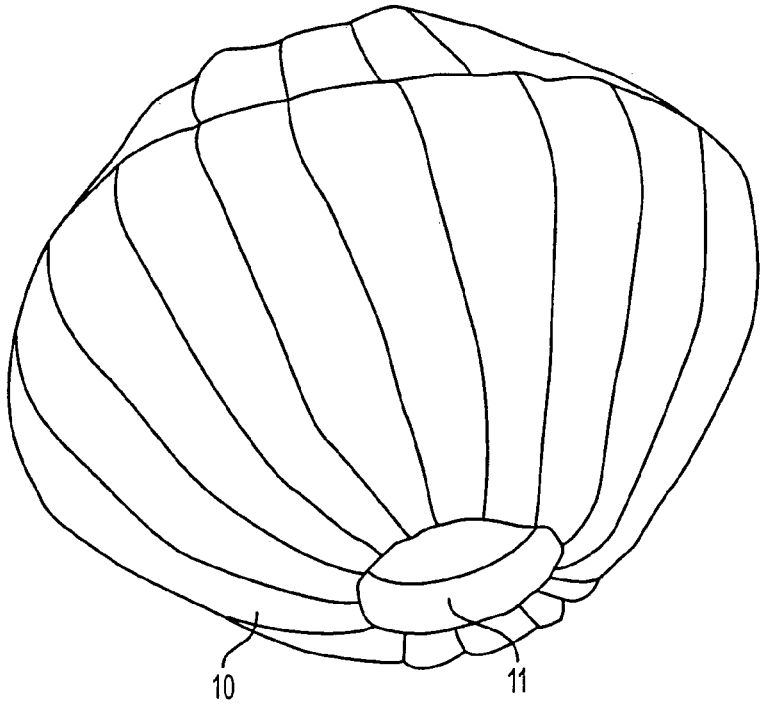
FIG. 1B shows a side view of a corner-roller cover.

FIG. 1A shows a top view of a covered spindle-shaped corner-roller cover 10. FIG. 1B shows a side view of the spindle-shaped covered corner-roller cover 10, and hole 11 through its side. The hole 11 can be any diameter to accommodate a wire roller. However, for a conventional wire roller four inches long, the diameter of the hole 11 is about 1.5 inches. The spindle-shaped cover is attached to the wire roller by inserting the roller into the hole 11 of the cover. The roller cover body 80 is made of a hollow rigid material (FIG. 8) which is then covered with a material that can hold coating material for application therefrom, as shown in FIGS. 1A and 1B. This spindle-shaped body can be made of any rigid material which will permit the attachment of fabric or paint absorbing material to its outer surface. Use of a plastic for the body makes the roller cover strong, lightweight and inexpensive to produce, although any suitable rigid material can be used for the spindle-shaped body.

The hollow body is overlaid with paint-roller fabric of various types. These fabrics can be of various nap thicknesses, pile heights, and texture to give the desired paint loading qualities and finish. The fabric is attached to the body of the cover with any type of adhering means, such as adhesives (e.g., epoxy or glue), VELCRO® fasteners, double-sided tape, and the like. The fabric used for the cover is cut into flat spindle-shaped pieces, which are then attached to the body of the roller cover with one piece closely abutting another around the entire circumference of the roller cover. These spindle-shaped pieces of fabric make it possible to construct the roller cover without forming puckers between the fabric and the body of the cover. Any shape of fabric which will cover the body of the roller cover without puckering can be used.

Figure 8:
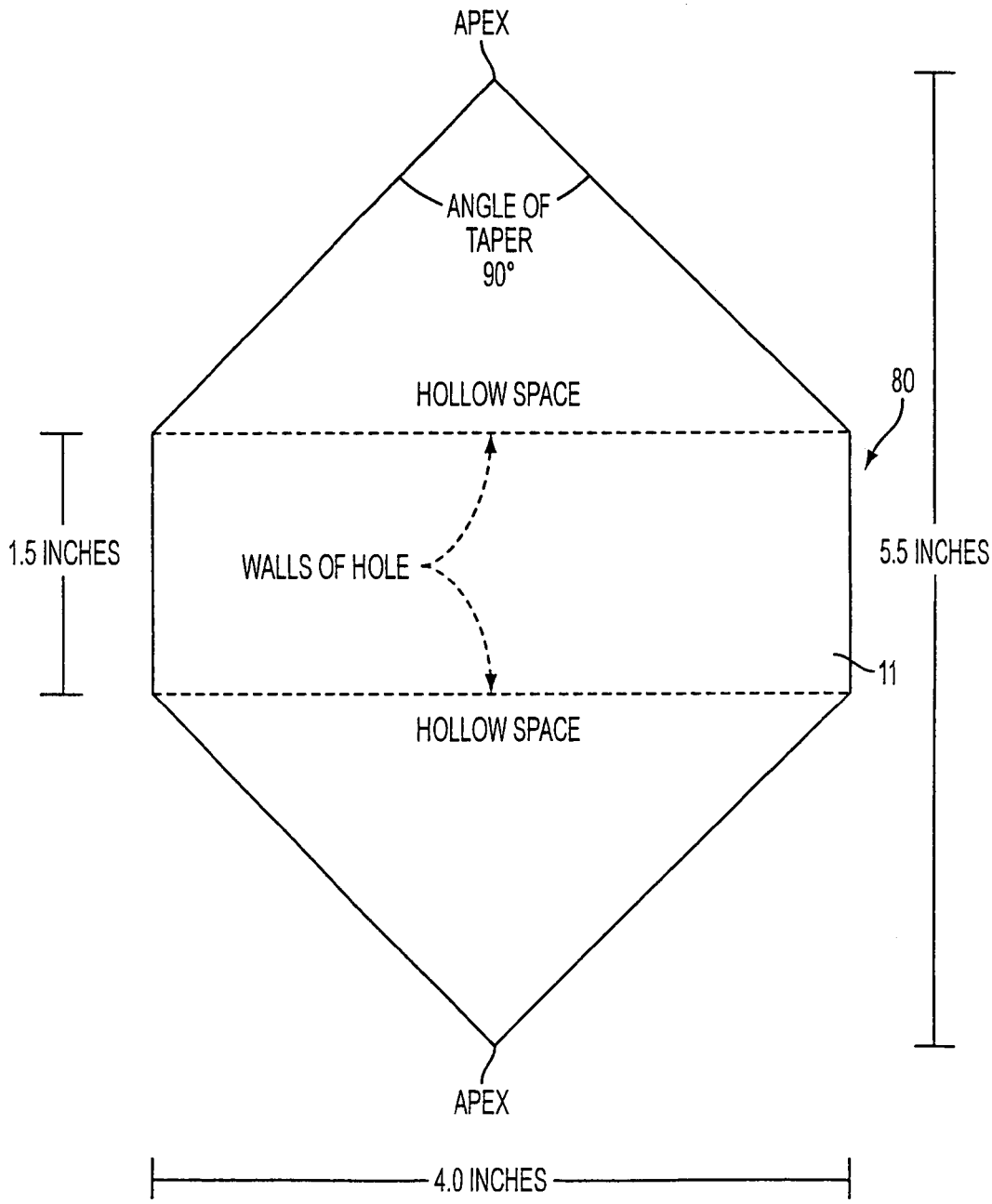
FIG. 8 is a diagram of a spindle-shaped roller cover.

The dimensions given in FIG. 8 are the exact dimensions of the corner-roller cover without a fabric covering. The diameter of the spindle-shaped cover when fabric is attached is greater than shown in FIG. 8, and depends on the thickness of the covering fabric. The diameter of the roller cover can be a function of the angle of taper of the spindle. If the angle of taper is greater than 90 degrees but less than 180 degrees, for a roller cover four inches long the diameter of the roller cover would be less than if the angle of taper were 90 degrees.

Figure 2A:
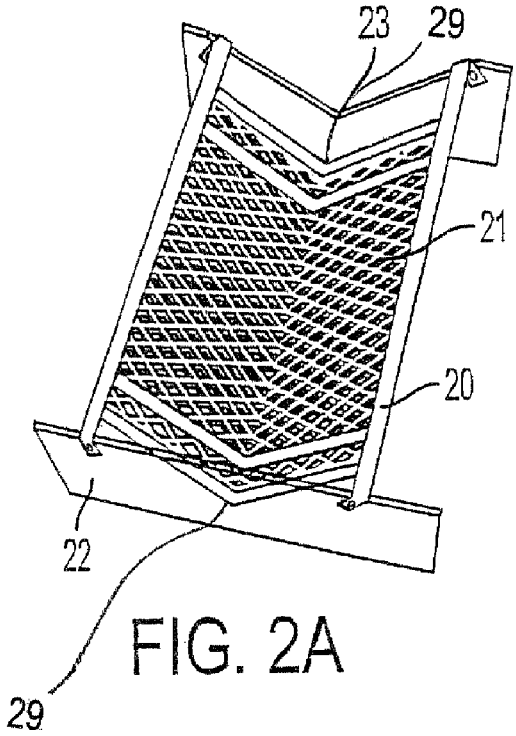
FIG. 2 shows a top view of a paint-pan adapter.
Figure 2B:
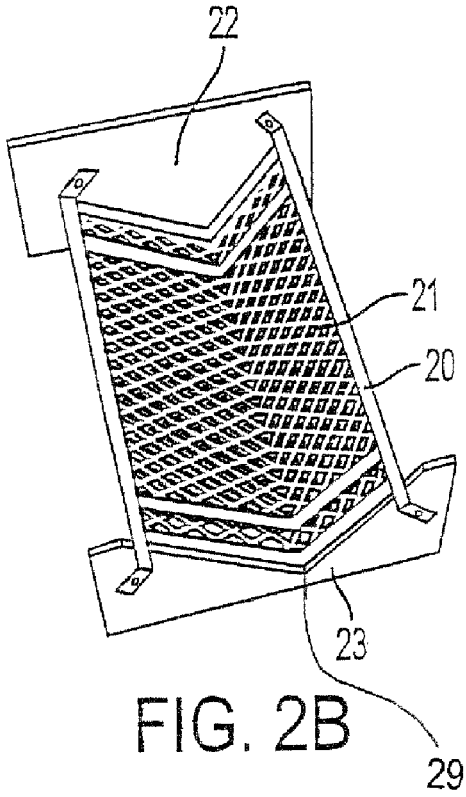

FIG. 2 is a top view of a paint pan adapter 20. The adapter has two end pieces, 22 and 23. One end piece 23 is V-notched to provide ready access for the roller cover to the contents of the paint pan. To provide additional rigidity to the entire structure end piece 23 is preferably not V-notched. The V-shaped grille base 21 provides traction for a roller and free access to liquid coating material in the paint pan.

Figure 3:
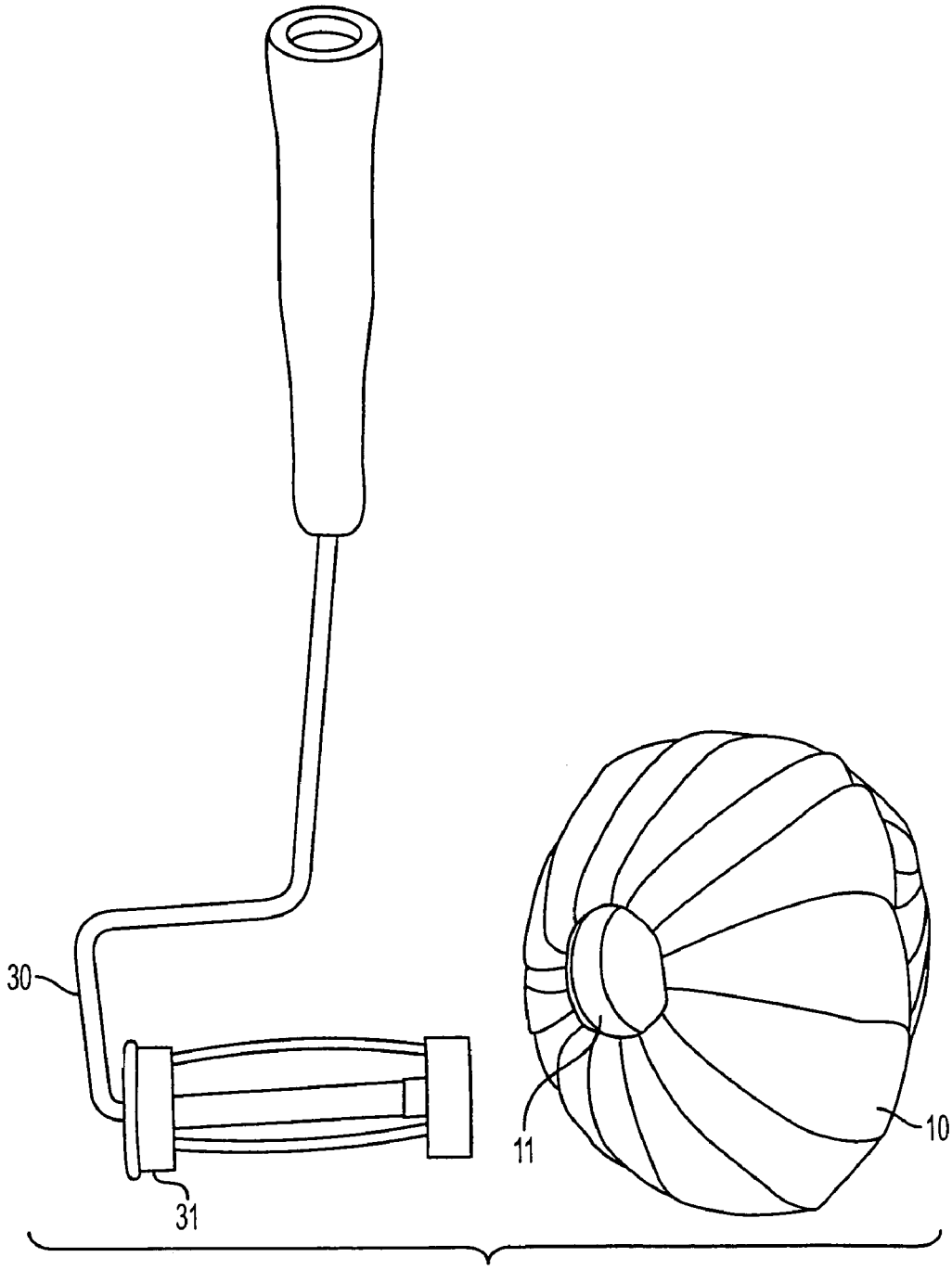
FIG. 3 shows a wire roller and a corner-roller cover.

FIG. 3 shows a wire roller 30 beside a covered corner-roller cover 10. The roller portion 31 of the wire roller fits into the hole 11 of the corner-roller cover.

Figure 4:
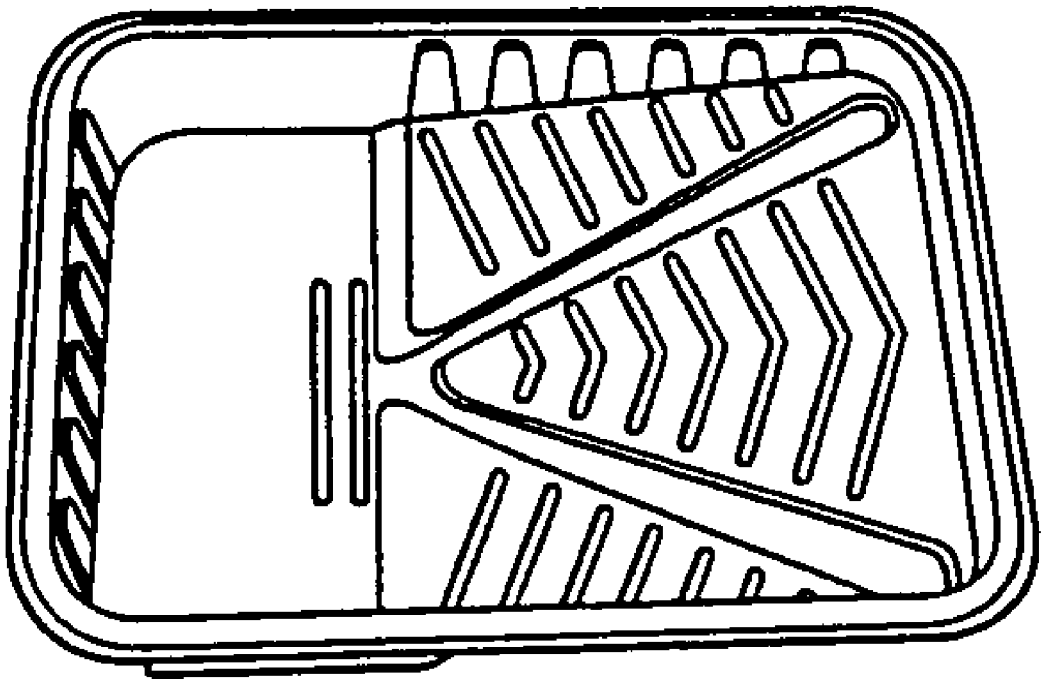
FIG. 4 shows a conventional paint pan.

FIG. 4 shows a conventional paint pan which is empty.

Figure 4A:
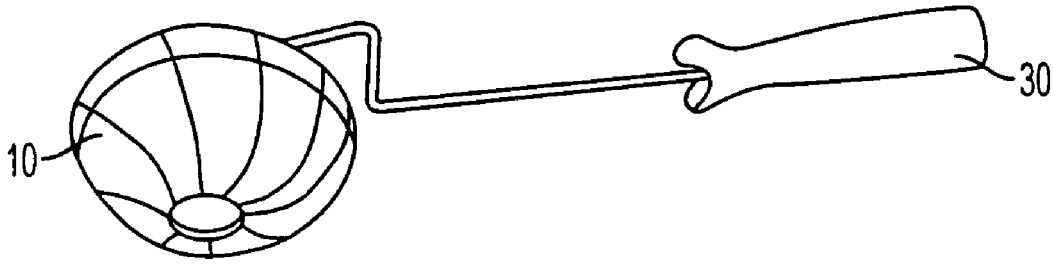
FIG. 4A shows a spindle-shaped cover attached to a wire roller ready for painting.

FIG. 4A shows the spindle-shaped covered corner roller cover 10 attached to a wire roller 30. This assembly is ready for painting.

Figure 5:
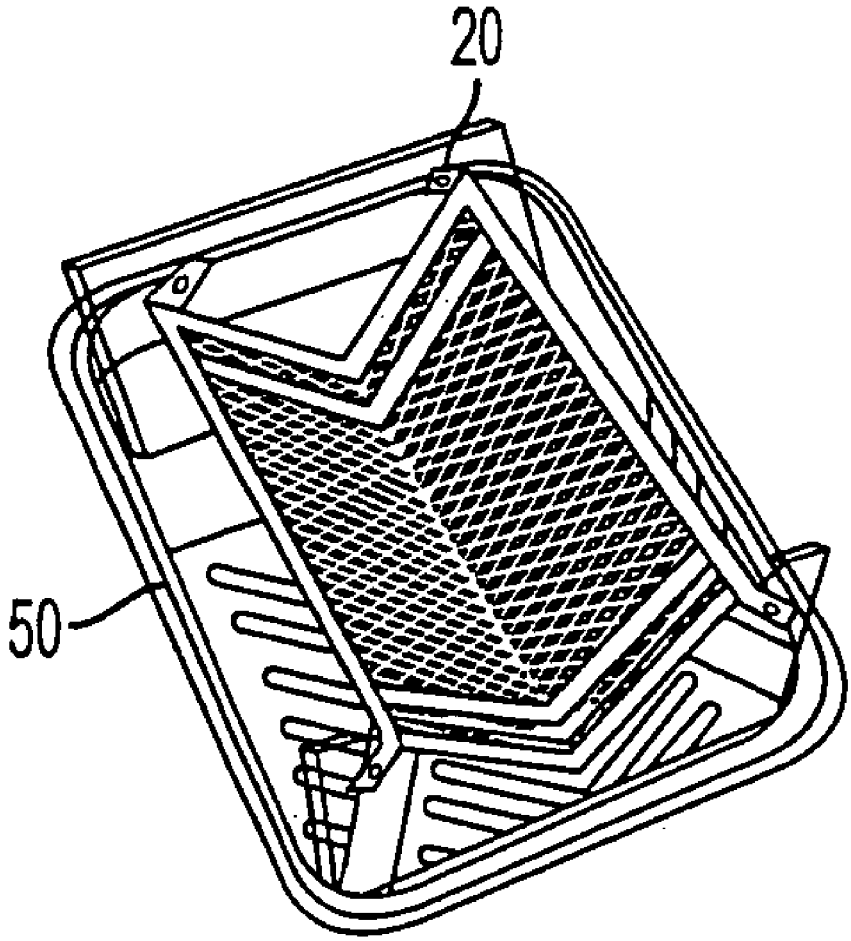
FIG. 5 shows a paint-pan adapter sitting in a conventional paint pan.

FIG. 5 shows a paint pan adapter 20 sitting in a conventional paint pan 50 with the V-notched end of the adapter placed at the shallow end of the paint pan. This provides free access to the coating material in the pan 50 through grille 21.

Figure 6:
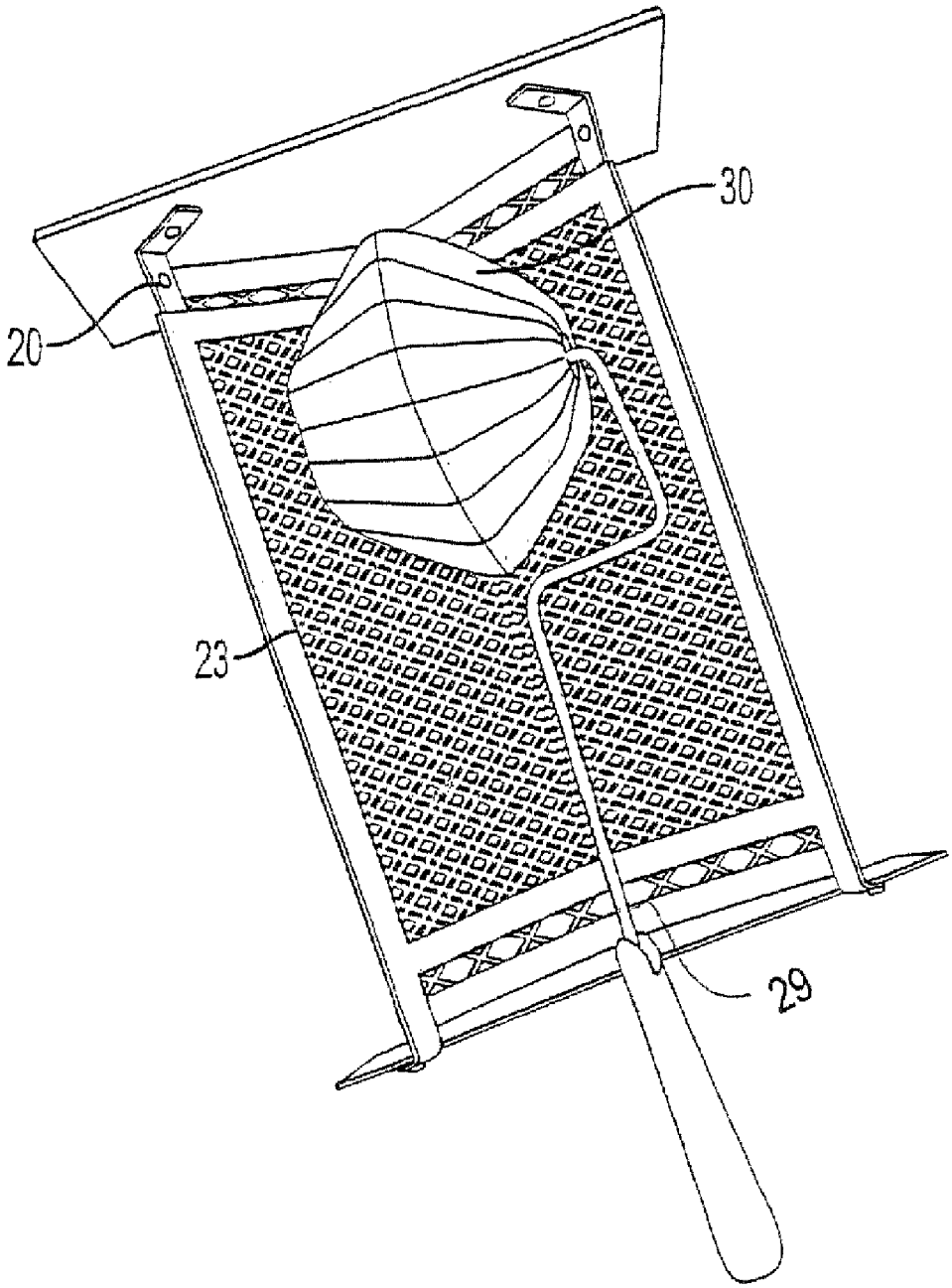
FIG. 6 shows a fully assembled corner roller sitting in a V-shaped body of the adapter.
Figure 7A:
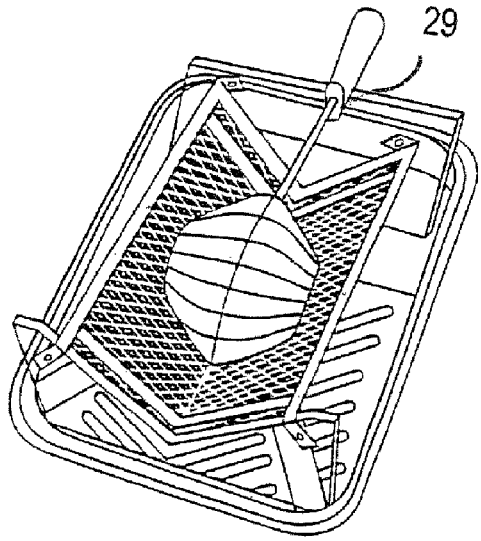
FIG. 7 shows a corner roller and paint pan in working position in a conventional paint pan.
Figure 7B:
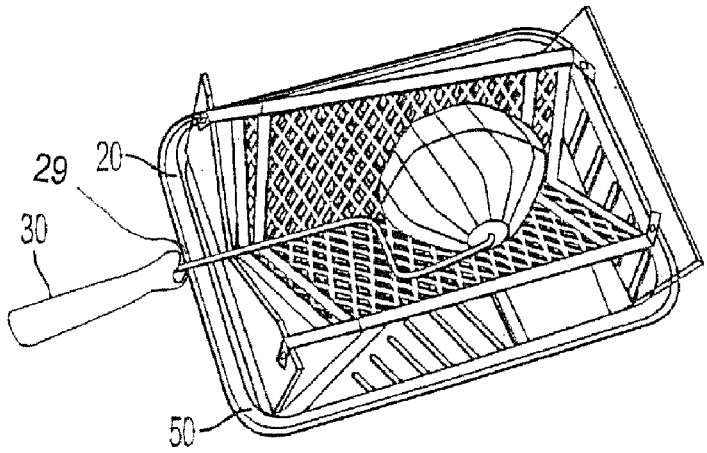

When loading the corner-roller cover with liquid surface coating such as paint, conventional paint pans are only marginally useful without the adapter. The roller has little or no traction in such pans, and the sliding action that results when the roller is dragged through the pan gives a very uneven loading of the roller with the liquid coating. Also, excess coating on the roller cannot be returned to the pan. This is all the result of the incompatibility of shapes of the spindle-shaped roller and a flat-bottomed paint pan. Flat-bottomed paint pans work well with conventional flat-surface roller covers. However, the spindle-shaped covers, which can apply paint in corners, require a shape in the paint pan that conforms to its own shape so that the roller can gain sufficient traction in the pan to acquire paint evenly on the roller cover. This traction allows it to roll in the pan rather that sliding in the pan. The roller cover must roll in the pan in order for it to be properly loaded with surface-coating material and to remove excess coating material from the roller. This is accomplished by providing the roller cover with a V-shaped bed to roll in while it collects coating or sheds excess coating, as shown in FIGS. 2, 5 and 6. Additionally, the irregular surface of the bed of the adapter, or grille, provides additional traction for the roller cover. The grille work of this bed gives the roller cover access to liquid coating residing in the reservoir of the paint pan (FIGS. 2, 5 and 7).

Grille 21 is shaped to conform to the dimensions of the covered corner roller cover. That is, the angle of intersection of the two sides of the grille is made so that the covered corner roller cover conforms to the dimensions of the grille. The grille can be made of any suitable material that provides traction to the covered corner roller cover, including plastics, metals, etc.

The front of the adapter is composed of a solid sheet of plastic or other rigid material to give the structure rigidity and to wedge the adapter into the front part of the paint pan for stability (FIGS. 2 and 5). At the opposite end of the adapter, another sheet of plastic or other rigid material, which provides rigidity to the structure and anchors the adapter to the rear of the paint pan (FIGS. 2 and 5). The front end plate of the adapter has a V-notch 29 which provides free access to the roller cover to the contents of the paint pan. The rear end plate of the adapter is preferably not notched so that the structure is rigid.

Preferably, the adapter is sized such that it sits snugly into a conventional paint pan, the walls of which hold the adapter in place while the roller cover is being coated with surface coating. The adapter can be easily removed by lifting it out of the paint pan. After removal of the adapter, the paint pan can be used with a conventional cylindrical roller to continue the painting.

The adapter is designed such that when it is in place in a conventional paint pan, at least 50% of the surface of the adapter will not be submerged in paint when the reservoir of the paint pan is filled with paint. To achieve this, the paint-pan adapter is preferably inclined from front to back so that the back half of the adapter does not sit in the pan (FIGS. 5 and 7). This provides a relatively dry rear area of the adapter which is used to roll excess paint off a roller cover. This excess paint readily flows back into the reservoir through the grille which makes up the V-shaped walls of the adapter (FIGS. 7 and 8).

The adapter can be made to fit any paint pan larger than the standard-size pan and some sizes a little smaller than standard size pan. The paint pan adapter can be made to fit any spindle-shaped roller whose angle of taper is somewhat less than 90 degrees and less than 180 degrees. The adapter can be made of any rigid material which gives traction to the roller cover. It also must permit the paint from the reservoir of the paint pan to come into contact with the roller cover. It also must let excess paint on the roller cover flow back into the reservoir of the paint pan.

FIG. 6 shows a fully assembled corner roller 30 sitting in the V-shaped bed or grille 23 of the adapter 20. The roller 30 picks up and sheds paint by rolling along the grille 23 of the adapter 20, which is designed to sit in a conventional paint pan.

FIG. 7 shows an assembled corner roller 30 and adapter 20 in place in a conventional paint pan 50. The shape of the roller 30 and the shape of the adapter 20 conform to each other. The adapter 20 is designed to fit snugly into a paint pan. Once paint or other coating material is added to the paint pan, the roller is ready for use.

FIG. 8 is a diagram of a spindle-shaped roller cover 80. The roller cover 80 is made of a rigid material, such as plastic, aluminum, or the like to which the paint fabric is permanently attached with adhesive material. In this embodiment, the angle of taper 81 is 90°. However, depending upon the concave angle of the corner to be painted, a roller cover with an angle of taper which conforms to the angle to be coated can be manufactured without a change in the basic design of the apparatus. Thus, roller covers can be provided with any desired angle of taper. The walls 82 of the hole 11 are designed for a wire roller to be inserted therein. The area between the walls 82 and the apices 84 of the corner roller cover may be hollow so that the corner roller cover is very light in weight. For a non-disposable corner roller cover, however, there may be supports in the spaces 83 to reinforce the side walls of the corner roller cover. In this example, the roller cover 80 is designed for use with a four-inch roller, so that the hole 11 is approximately four inches in length.

Figure 9:
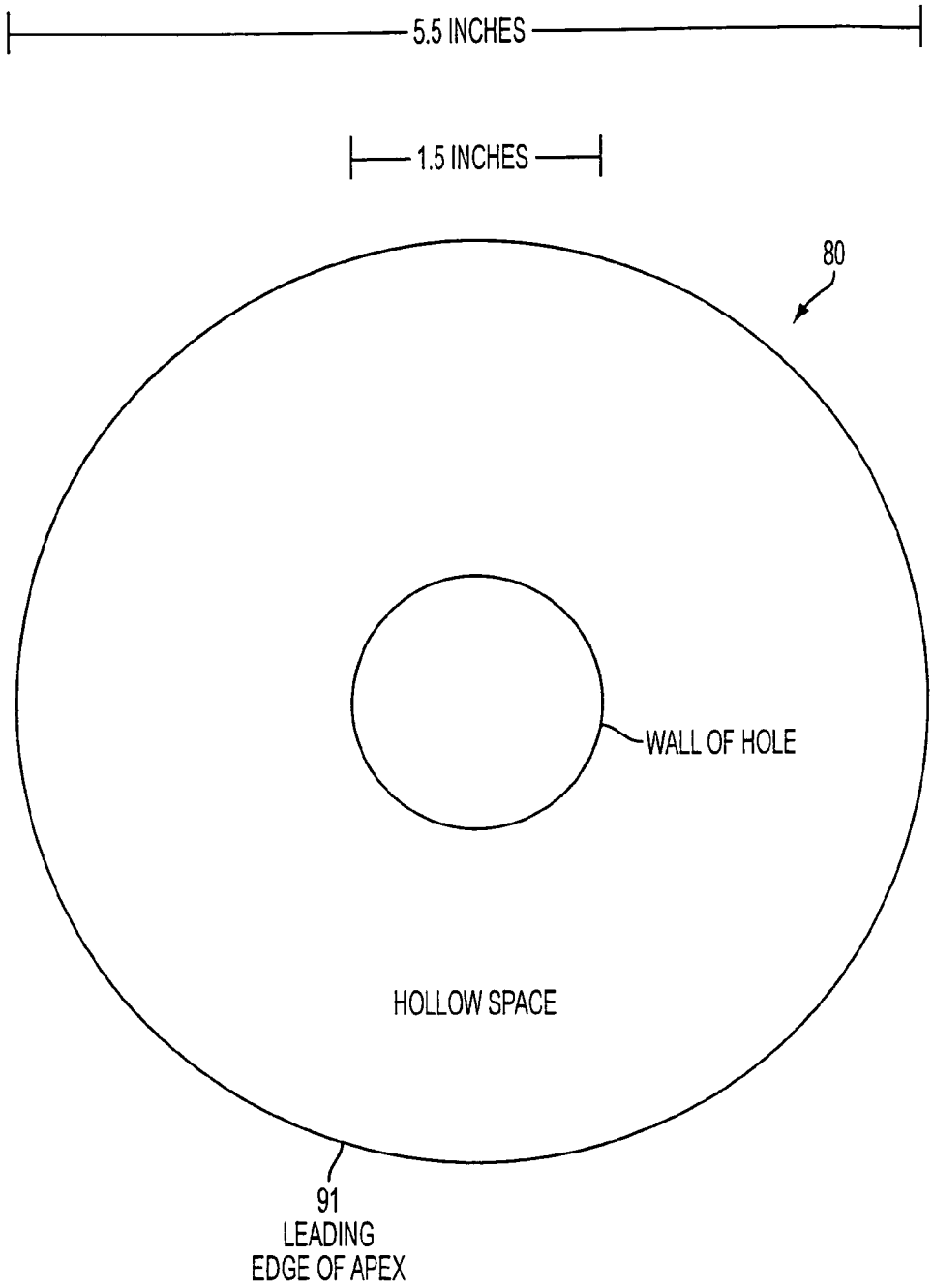
FIG. 9 is a diagram of the side view of a corner-roller cover.

FIG. 9 is a side view of the corner-roller cover 80. The leading edge of the apex is shown as 91.

The corner roller system is used with two commercially available items: a wire roller, and a conventional paint pan. For purposes of illustration, the wire roller has a length of about four inches. However, longer or shorter wire rollers can be used, with the size of the paint pan and the adapter being adjusted to accommodate larger rollers where necessary. The paint pan is approximately fourteen inches long, eleven inches wide, and 2.5 inches deep. Typically, a paint roller consists of a wire roller and a cylindrical roller cover. However, this type of roller does not reach into the depth of a corner well enough to give the painted surface a finished look. However, the corner-roller with its spindle-shape design attached to a wire roller fits into the depth of a corner so that the entire corner can be coated. The spindle shape of the corner-roller cover makes it possible to paint in deep corners, including corners which meet at a ceiling. The V-shaped walls of the adapter have the same taper as the spindle shape of the corner-roller cover, as shown in FIG. 6. There is a hand-in-glove fit between the adapter and the corner-roller cover as the corner-roller cover rolls along the V-shaped bed (or grille 23) of the adapter, as shown in FIG. 7. This conformity provides traction for the roller, which causes it to roll rather than slide in the reservoir of the paint pan that holds the liquid coating material. In order that the roller cover be properly loaded, the cover must roll rather than slide when it is either collecting or shedding paint or other coating material. The adapter makes it possible to use a conventional paint pan as a reservoir for surface coatings which can be accessed with the corner-roller cover. The adapter makes it possible easily to load paint or other coating material onto the corner-roller cover.

The corner roller-cover is most efficient when the angle between the two intersecting surfaces approximates 90 degrees. However, corner-roller covers can be made to accommodate angles of intersecting surfaces which are less than 180 degrees by changing the angle of taper of the roller cover so that it approximates these angles between the two surfaces. The width of the corner-roller covers having different angles of taper can be of any length that fits onto a wire roller. The most common wire roller for corners is approximately four inches long, although wire rollers and corner-roller covers of any length can be used.

The corner-roller cover can be fashioned to give different surface finishes by changing the thickness, composition and texture of the fabric used for the roller cover. This makes it possible to match exactly the corner finish with that achieved on the rest of the wall where flat rollers are used. This matching of finishes is rarely accomplished when the corner is painted with brush, spray, pad, or sponge and the remainder of the wall is painted with conventional rollers.

The V-shaped adapter can be altered to accommodate the angle of taper of the corner-roller cover by widening the V-shaped portion to fit the taper of the roller cover. The overall dimensions of the adapter can be enlarged to fit larger paint pans. The adapter can be made from a combination of plastic frame with a metal grille, or from any number of rigid materials which are resistant to chemical attack by the surface coating. These rigid materials must be perforated in some way to allow excess paint to flow back into the reservoir from the roller cover, and they must have a corrugated or roughened surface to provide needed traction to the roller cover so that it rolls when being loaded with coating material. The grille can have any desired configuration of openings through which paint can pass.

The covered spindle-shaped corner-roller cover, and a paint pan adapter comprise the present system. This is an effective, versatile, and rapid system for applying a liquid surface coating such as paint to corners, including concave corners, of adjoining surfaces. Because of the quick roller action, corners are quickly and evenly coated. The corner-roller cover delivers a high volume of paint to corner spaces because of the absorbent qualities of the paint roller fabric and the rolling action of the roller. Additionally, the corner-roller cover lays down a sufficiently wide layer of paint so that a smoother overlap with paint applied with a conventional roller on the flat part of the surfaces can be obtained.

The spindle-shaped roller cover is easily loaded with paint using the adapter provided. Because the corner roller cover is rolled along the grille of the adapter after being loaded with paint, excess paint drops off back into the paint pan, and there is minimal dripping. The corner roller cover is used with a conventional wire roller, so that a conventional extension can be attached to the roller, making use of a ladder unnecessary.

The corner roller cover can be made of inexpensive, lightweight materials to make it disposable. Alternatively, the corner roller cover can be made of more durable material so it can be cleaned and reused. If the corner roller cover is hollow, it is very light in weight. Different paint cover fabrics can be used for coverings. That is, the pile height, texture, and nap of the coverings are provided to produce a desired finish and to match the remainder of the room painted with a conventional cylindrical roller.

The angle of taper of the spindle-shaped corner roller cover can be designed to match the angle of two adjoining surfaces.

The paint-pan adapted makes it possible for the corner-roller cover to easily and rapidly load paint from a conventional paint pan. The adapter is lightweight yet sturdy and is easily portable. The construction of the grille in the adapter affords the corner roller cover traction and access to surface coating material in the paint pan reservoir. The durable construction of the adapter allows for reuse after cleaning, although the cost of construction makes it disposable if so desired. The adapter can easily be designed and manufactured to fit corner roller covers with angles of taper larger than 90 degrees.

Finally, this roller cover is easily assembled onto the wire roller without the use of nuts and bolts. It is also easily dissembled. Nothing protrudes from this roller to gouge a painted surface. There is no possibility of the paint fabric dislodging from the roller cover.

It is to be understood that the phraseology or terminology employed herein is for the purpose of description and not of limitation. The means and materials for carrying out various disclosed functions may take a variety of alternative forms without departing from the invention.

Thus, the expressions "means to . . . " and "means for . . . " as may be found in the specification above and/or in the claims below, followed by a functional statement, are intended to define and cover whatever structural, physical, chemical, or electrical element or structures which may now or in the future exist for carrying out the recited function, whether or nor precisely equivalent to the embodiment or embodiments disclosed in the specification above. It is intended that such-expressions be given their broadest interpretation.

What is claimed is:

1. A system for painting corners where a least two surfaces come together comprising:

a. a corner roller cover in the shape of a spindle, said roller cover consisting of a rigid body that is covered over its entire outer surface with a paint fabric, said paint fabric being permanently attached to said outer surface;

b. a paint pan adapter, said adapter comprising a first rectangular end plate and a second rectangular end plate and a V-shaped trough between said first end plate and said second end plate;

c. wherein the bottom edge of the first end plate and second end plate sits firmly on the floor of a paint pan;

d. wherein one of the first and second endplates has a V-shaped notch, which V-shaped notch is sufficiently large to provide easy access for the roller body to the V-shaped trough of the paint pan adapter;

e. wherein the V-shaped trough is made of a grille comprising a plurality of holes through the length of said trough, whereby the holes provide traction for the roller cover when the adapter and roller are in use and the holes permit paint to flow from a reservoir of a paint pan to the roller cover and excess paint on the roller cover to flow back into the reservoir of the paint pan when the roller cover is covered with paint.

2. The system according to claim 1 wherein the spindle-shaped corner roller cover has the same taper as the V-shaped trough of the paint pan adapter.

3. The system according to claim 1 wherein the taper of the spindle-shaped corner roller cover is of approximately 90°.

4. The system according to claim 1 wherein the roller cover is formed by abutting individual spindle-shaped pieces of paint fabric or an array of individual spindle-shaped pieces of paint fabric which are sequentially joined at their equators around the entire circumference of the rigid body.

* * * * *